US005549450A

United States Patent [19]

Mann et al.

[11] Patent Number: 5,549,450

[45] Date of Patent: Aug. 27, 1996

[54] CENTRIFUGAL PUMP OF THE SECTIONAL-CASING DESIGN

[75] Inventors: Ralf Mann, Huje; Wilfried Lehmann, Heiligenstedten; Hermann Müller, Oldendorf, all of Germany

[73] Assignee: Sihi GmbH & Co KG, Itzehoe, Germany

[21] Appl. No.: 403,710

[22] PCT Filed: Sep. 22, 1993

[86] PCT No.: PCT/EP93/02570

§ 371 Date: Mar. 16, 1995

§ 102(e) Date: Mar. 16, 1995

[87] PCT Pub. No.: WO94/07031

PCT Pub. Date: Mar. 31, 1994

[30] Foreign Application Priority Data

Sep. 24, 1992 [DE] Germany ..... 42 32 020.8

[51] Int. Cl.[6] ..... F04D 29/44

[52] U.S. Cl. ..... 415/214.1; 415/199.1; 415/199.2

[58] Field of Search ..... 415/199.1, 199.2, 415/214.1, 215.1

[56] References Cited

U.S. PATENT DOCUMENTS

| | | | |
|---|---|---|---|
| 3,051,090 | 8/1962 | Zumbusch | 415/214.1 |
| 3,927,763 | 12/1975 | Strub et al. | 415/199.2 |
| 4,116,583 | 9/1978 | Budris | 415/199.1 |
| 4,120,606 | 10/1978 | Reiss | 415/215.1 |
| 4,264,285 | 4/1981 | Erickson et al. | 417/405 |
| 4,708,589 | 11/1987 | Nielsen et al. | 415/199.2 |
| 4,778,334 | 10/1988 | Medgyesy et al. | 415/199.1 |
| 4,781,531 | 11/1988 | James | 415/199.1 |
| 5,201,633 | 4/1993 | Peu | 415/199.1 |
| 5,385,445 | 11/1995 | McKenna | 415/214.1 |
| 5,407,323 | 4/1995 | Gay et al. | 415/199.1 |

FOREIGN PATENT DOCUMENTS

| | | | |
|---|---|---|---|
| 0248104A1 | 12/1987 | European Pat. Off. | F04D 29/62 |
| 536590 | 5/1922 | France . | |
| 2614163B1 | 3/1977 | Germany | F04D 1/06 |
| 2808586 | 11/1978 | Germany | 415/214.1 |
| 2808741A1 | 9/1979 | Germany | F04D 29/40 |
| 9407031 | 3/1994 | WIPO | 415/215.1 |

OTHER PUBLICATIONS

Soviet Patents Abstracts, Section PQ, Week 9139, Nov. 13 1991, Derwent Publications Ltd., London, GB; Class Q56, 91-286368/39;SU 1620-682 A; 1/91; F04D-01/06.

*Primary Examiner*—Edward K. Look
*Assistant Examiner*—Mark Sgantzos
*Attorney, Agent, or Firm*—Chilton, Alix & Van Kirk

[57] ABSTRACT

Centrifugal pump of the sectional-casing design, in which the casing sections (8, 9) each have a cylindrical casing shell and inner-wall parts (12–15) connected thereto in one piece. The casing shell of at least one casing section (8, 9) is composed of an outer, continuous shell part (24, 25) and of at least two separate inner shell parts (19–22) with respective associated inner-wall parts (12–15). The outer and the inner shell parts are expediently connected firmly to one another, especially by shrink bonding.

7 Claims, 1 Drawing Sheet

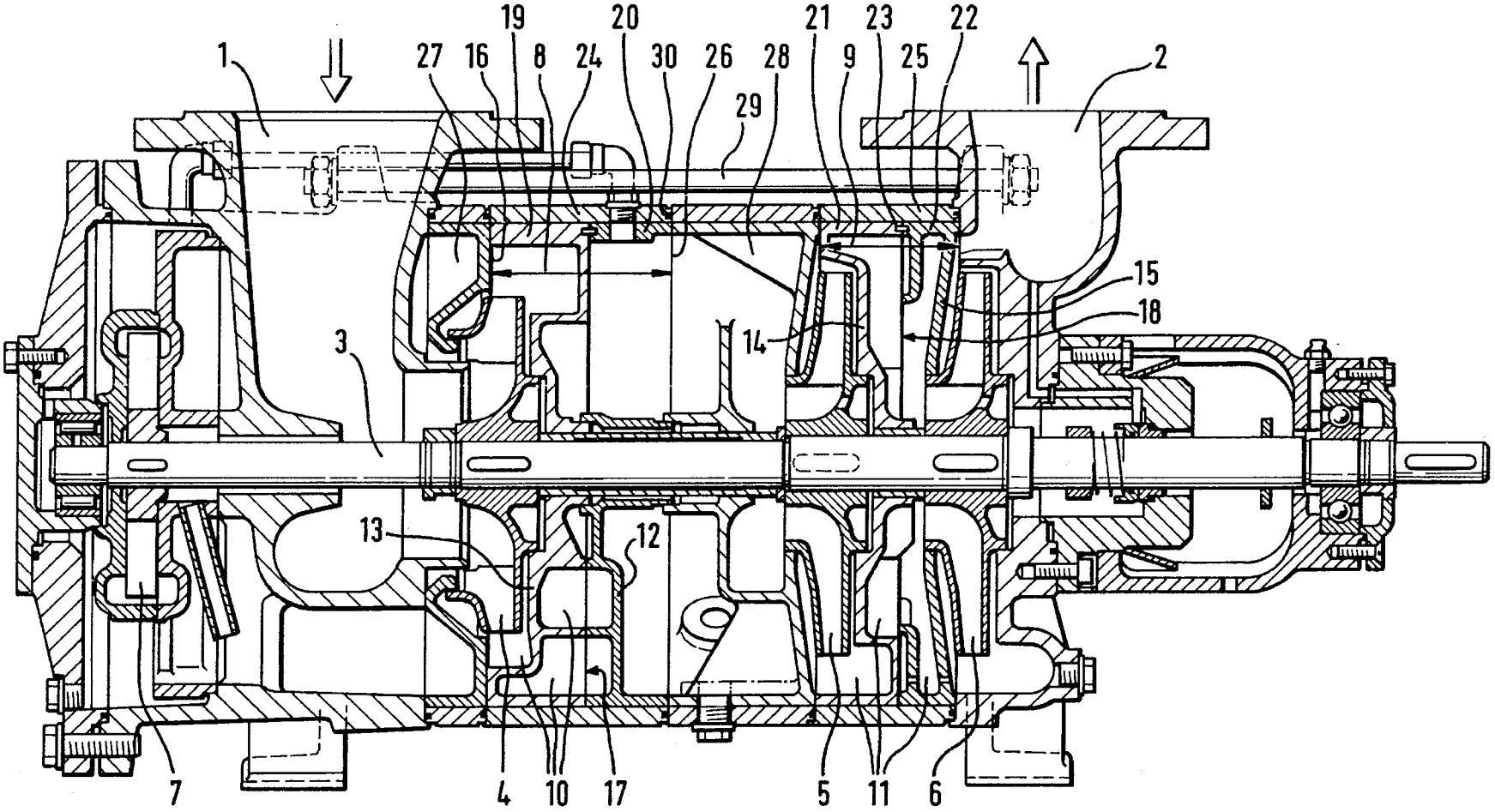
2
22
25
23
9
21
28
29
26
30
20
24
8
19
16
27
1
15
18
14
3
12
13
6
11
5
17
10
4
7

CENTRIFUGAL PUMP OF THE SECTIONAL-CASING DESIGN

BACKGROUND OF THE INVENTION

It is widely customary, for the different operating parts of a centrifugal machine, to provide casings having an identical shell diameter which are lined up axially in succession and which are clamped together by means of the end faces of their shells. At the same time, each casing shell includes the inner walls which govern the operation of the particular casing section. These inner walls, which define flow paths and media spaces, form sometimes complicated hollow shapes and undercut contours which can be produced by casting only at a high outlay. This is also true when the casing sections are surrounded by means of a tube absorbing the axial forces and centring the casing shells (U.S. Pat. No. 4,708,589) or stepped casings are arranged within an outer casing, leaving a functional interspace (EP-A-0 248 104). However, because there is then a larger number of casing sections, it would involve an even higher outlay, particularly in terms of stockkeeping, assembly and maintenance, to divide sections of this kind once more in order to make the cavities and undercut regions more readily accessible in the casting technique.

SUMMARY OF THE INVENTION

The invention is intended to simplify the production conditions, without impairing the uniform handling capacity of the casing sections. This is achieved by means of the features of the present invention.

Accordingly, there are individual casing sections, the casing shell of which is composed of an outer shell part continuous over the length of the respective section and of at least two separate inner shell parts having respectively associated inner-wall parts. The outer and inner shell parts are preferably connected firmly to one another. For example, they can be adhesively bonded or secured by heat shrinking one to the other. Adhesive shrinkage is preferred in order to exclude crevice corrosion. The remaining casing sections, the inner-wall parts of which do not have such a complicated construction, can be designed conventionally with only one casing shell. However, in these too, it may be expedient to make the casing shell multi-part in the way specified, in order to produce identical shell properties in all or most of the casing sections, particularly with regard to their strength.

The invention also has the advantage that different materials can be used for the inner and the outer shell part. For example, rolled material of high tensile strength can be used for the outer shell part, whilst the inner shell part consists of cast material. As a result, the wall thickness as a whole, but at least the thickness of the inner shell part, and therefore the cast weight, can be reduced. This advantage is known per se DE-A 28 08 741, FR-A 536 590).

The seals between successive casing sections are expediently provided on the outer shell part. It is also possible, however, to mount them on the inner shell part or so as to engage over both shell parts.

Since the inner shell parts are responsible for the correct axial positioning of the inner-wall parts, it is usually recommended to cause the end faces of the inner shell parts of successive casing sections to be contiguous with one another. High accuracy can be achieved especially when the shell end faces, each composed of an outer and an inner shell part, are machined in a unitary manner (in one operation).

BRIEF DESCRIPTION OF THE DRAWING

The invention is explained in more detail below with reference to the drawing which illustrates an advantageous exemplary embodiment in longitudinal section.

DESCRIPTION OF A PREFERRED EMBODIMENT

This relates to a liquid pump with a suction connection 1, a delivery connection 2, a shaft 3, three fully loaded impellers 4, 5, 6 and one partly loaded impeller 7 guaranteeing the self-priming capacity of the pump.

The fully loaded impellers 4 and 5 are located in stepped casings 8 and 9 which each receive the impeller and which form the distributor chambers 10 and 11. These chambers or closed spaces, are located between axially successive said complementary inner-wall parts 12 to 15, and are formed by the complementary end surfaces thereof.

The production of the casing sections 8 and 9 containing these undercut inner-wall parts becomes easier if these casing sections are subdivided along the dividing plane 17 and 18. This results, in each case, in two abutting complementary subsections, which respectively include the inner shell parts 19 and 20, and 21 and 22. These cylindrical parts are integral with, the inner-wall parts 12 and 13, and 14 and 15. These inner shell parts are surrounded in turn, in each case, by an outer shell part 24 and 25 which may be heated and subsequently thermally shrunk, preferably adhesive bonding onto the inner shell parts 21 and 22. The outer shell part extends over the length of the respective casing section. The correct position of the inner shell parts relative to one another is fixed beforehand by pinning 23, if this is necessary.

This results in a unitary casing section 8 and 9 which combines all the functions attributable to this casing section also in the known version which is one piece as a whole, and they can be handled in a unitary manner in the usual way during stockkeeping and assembly.

So that the inner and the outer shell parts have identical axial dimensions, this being advantageous (although not necessary) with a view to the clear positioning of the inner wall parts and from a sealing point of view, the casing sections 8, 9 are remachined on the end faces 26 after their shell parts have been inserted one in the other. The annular grooves provided therein for receiving a seal 30 are located in the respective outer shell part. The casing sections are clamped together by means of the bolts 29 which extend over and beyond all the casing sections and which function as a tension device.

In the example shown, not only the casing shells of the casing sections 8 and 9, subdivided once more internally, are made in two parts in the shell region, but also the casing sections 27, 28, although this would not be absolutely necessary in respect of their inner-wall parts 16. It is expedient, however, if the casings of all the sections are of identical construction, so that they can have an identical rating in terms of strength and their cast portions can be reduced in an identical way.

We claim:

1. In a centrifugal pump having a plurality of casing sections (8, 9, 27, 28) with confronting end faces on adjacent casing sections, said confronting end faces, being clamped together by means of a tension device (29) extending over them, at least one casing section (8, 9) having a plurality of axially successive inner walls (12, 13, and 14, 15) surrounded by a cylindrical casing shell, the improvement wherein the casing shell of said at least one casing section (8 and 9) is composed of a plurality of inner shell parts integral with said inner walls and an outer shell part (24 and 25) extending over the axial length of said plurality of inner shell parts, said outer shell part being securely connected to the underlying inner shell parts in its casing section.

2. The centrifugal pump according to claim 1, characterized in that the secure connection between the outer and inner shell parts in each casing section results from adhesive bonding of the inner and outer shell parts to one another.

3. The centrifugal pump according to claim 1, characterized in that the outer and inner shell parts are securely connected by shrinking one shell part on the other.

4. The centrifugal pump according to claim 1, wherein at least one casing section (27, 28) is composed of an outer shell part and a single inner shell part securely connected thereto.

5. The centrifugal pump according to claim 1, characterized in that pressure-resistant seals (30) are arranged between the outer shell parts of adjacent casing sections at the confronting end faces of said sections.

6. The centrifugal pump according to claim 1, characterized in that the confronting end faces are composed of an outer shell part and of at least one inner shell part that are machined in a single operation.

7. A process for producing a casing section of a multisectional centrifugal pump comprising the steps of providing a casing section having a casing shell composed of an outer shell part and at least one inner shell part, securely connecting the outer and inner shell parts to one another to form a section end face composed of both the outer and inner shell parts, and subsequently machining each composed end face of the casing section in a single operation.

* * * * *